United States Patent [19]

Bhattacharya et al.

[11] 4,236,939

[45] Dec. 2, 1980

[54] SEMI-FINISHED STEEL ARTICLE AND METHOD FOR PRODUCING SAME

[75] Inventors: Debanshu Bhattacharya, Matteson, Ill.; Dennis T. Quinto, St. John; Michael O. Holowaty, Crown Point, both of Ind.

[73] Assignee: Inland Steel Company, Chicago, Ill.

[21] Appl. No.: 5,965

[22] Filed: Jan. 24, 1979

[51] Int. Cl.[3] ..... C22C 38/60

[52] U.S. Cl. ..... 148/2; 75/123 AA; 75/123 F; 148/12 F

[58] Field of Search ..... 148/2, 12.1, 12 B, 12 F; 75/123 A, 123 AA, 123 G, 123 R, 123 F

[56] References Cited

U.S. PATENT DOCUMENTS

| | | | |
|---|---|---|---|
| 3,679,400 | 7/1972 | Nachtman | 75/123 AA |
| 3,723,103 | 3/1973 | Kato et al. | 75/123 AA |
| 3,973,950 | 8/1976 | Itoh et al. | 75/123 AA |
| 3,981,752 | 9/1976 | Kranenberg et al. | 148/12 B |
| 4,004,922 | 1/1977 | Thivellier et al. | 75/123 AA |
| 4,060,428 | 11/1977 | Wilson et al. | 148/12 B |

FOREIGN PATENT DOCUMENTS

| | | | |
|---|---|---|---|
| 47-206 | 11/1972 | Japan | 75/123 AA |

*Primary Examiner*—L. Dewayne Rutledge
*Assistant Examiner*—Peter K. Skiff
*Attorney, Agent, or Firm*—Merriam, Marshall & Bicknell

[57] ABSTRACT

A steel billet is produced having free machining properties and substantially devoid of surface-cracking in the as-deformed condition and without surface conditioning. The steel contains bismuth and tellurium and may contain lead but in a smaller amount than is conventional in leaded, free machining steels. The billet was hot deformed at a temperature above about 920° C. (1700° F.) and below 1150° C. (2100° F.). The steel contains inclusions of MnTe and $Bi_2Te_3$ as well as elemental Bi.

6 Claims, No Drawings

SEMI-FINISHED STEEL ARTICLE AND METHOD FOR PRODUCING SAME

BACKGROUND OF THE INVENTION

The present invention relates generally to elongated semi-finished, free machining steel articles and more particularly to such articles which are free of surface cracking and to methods for producing such articles.

A semi-finished steel shape is a bloom or a billet, the latter having a smaller cross-section than the former.

The machinability of steel is increased by adding alloying ingredients such as sulfur, lead, tellurium and bismuth.

In one type of manufacturing operation for producing a semi-finished steel shape having a free machining composition, molten steel, containing at least some of the machinability increasing ingredients described above, is poured into an ingot mold where the steel is cast into an elongated solid shape. After cooling, the ingot is reheated and subjected to a hot rolling operation which rolls the ingot into a bloom, and the bloom is then reheated and subjected to a further hot rolling operation to form the bloom into a billet. The billet is subsequently rolled into a bar, which is a finished steel shape.

In another form of manufacturing operation, the steel is continuously cast as strands having the cross-section of a billet, the strand is subjected to a roll bending operation or a roll straightening operation while the steel is at a hot deforming temperature, and, after the roll straightening operation, the strand is cut into billet lengths.

The hot rolling of the ingot into a bloom and the hot rolling of the bloom into a billet are generally performed at a hot rolling temperature in the range 920°–1150° C. (1700°–2100° F.). The roll straightening of a continuously cast strand is generally performed at a temperature in the range 920°–1100° C. (1700°–2000° F.). The hot rolling of the ingot into a bloom, the hot rolling of the bloom into a billet, and the roll straightening of the continuously cast strand are all hot deforming operations, and the temperature ranges described above are the typical, normal temperature ranges used for these hot deforming operations.

When tellurium is present in a free machining steel, all the tellurium is in inclusion form, principally as lead telluride (PbTe) when lead is also present. Some of the tellurium may also be present as manganese telluride (MnTe).

In steels containing lead and tellurium, an undesirable phenomenon occurs at the temperature range normally utilized for hot deforming. This phenomenon, known as surface cracking or surface checking or surface tearing, is manifest by a large number of small cracks or checks at the surface of the semi-finished steel article, particularly along the corners. Severe surface checking renders a steel article commercially unacceptable.

Surface cracking has been recognized in the prior art, and attempts to combat this phenomenon have also been described in the prior art. More specifically, attempts to combat surface cracking include reheating the unfinished steel article without flame impingement on the surface of the unfinished article (U.S. Pat. No. 3,287,954 Schrader et al), reducing the moisture content in the atmosphere of the reheating furnace (U.S. Pat. No. 3,365,922 Conces et al), removing the surface and first sub-layer of the unfinished steel article, e.g. by scarfing, after reheating (U.S. Pat. No. 3,382,700 Heitmann et al) and providing a blanket of nonoxidizing gas around the steel articles as they undergo reheating (U.S. Pat. No. 3,710,608 Hentz et al).

Typical examples of steel containing both lead and tellurium are disclosed in Holowaty U.S. Pat. No. 3,152,889.

SUMMARY OF THE INVENTION

In accordance with the present invention, it has been determined that surface cracking in free machining steels containing lead and tellurium can be reduced or eliminated by utilizing hot deforming temperatures above 1150° C. (2100° F.), but this expedient is practical only to the extent that such increased temperatures can be utilized without burning the steel.

Further in accordance with the present invention, it has been determined that, if the amount of lead telluride in the microstructure of the steel is substantially reduced, then the extent to which the steel undergoes surface cracking during hot deforming is also substantially reduced, if not entirely eliminated. However, to reduce the amount of lead telluride present requires a substantial reduction of either the lead content or the tellurium content or both, and this reduces the machinability of the steel which would be undesirable.

In accordance with the present invention, it has been determined that the susceptibility of the steel to surface cracking can be substantially minimized without reducing the machinability of the steel by completely replacing the lead with bismuth or by (1) replacing a substantial part of the lead with bismuth and (2) substantially reducing the tellurium content of the steel. These compositional changes have the net effect of eliminating or minimizing the formation of lead telluride.

In conventional free machining steels, lead is normally present in the range 0.25–0.35 wt.% and tellurium is normally present in the range 0.04–0.06 wt.%. In accordance with the present invention, the lead content is either eliminated entirely or, if not eliminated entirely, it is reduced from 0.25–0.35 wt.% to 0.15 wt.% maximum and the tellurium is reduced from 0.04–0.06 wt.% to 0.02 wt.% maximum. The reduction in machinability resulting from the lower lead and tellurium contents is offset by adding bismuth in the range of 0.10–0.40 wt.%.

In the absence of lead, instead of forming lead telluride, the tellurium is present either as bismuth telluride ($Bi_2Te_3$) or as manganese telluride (MnTe) which may be in the form of a eutectic with manganese sulfide (MnS). Where substantial amounts of manganese telluride are present in the microstructure of the steel (e.g. in the absence of lead), the hot deforming temperature should preferably be conducted within the range 920°–1035° C. (1700°–1900° F.). This is to offset the tendency of substantial amounts of manganese telluride to cause surface cracking during hot rolling at temperatures substantially exceeding 1035° C. (1900° F.), e.g. if the steel undergoes hot rolling at a temperature of about 1150° C. (2100° F.).

Other features and advantages are inherent in the subject matter claimed and disclosed or will become apparent to those skilled in the art from the following detailed description.

DETAILED DESCRIPTION

A free-machining, elongated, semi-finished steel shape devoid of surface cracking in accordance with the present invention can be produced by a method in accordance with the present invention utilizing two different casting procedures, either ingot casting or continuous casting. No matter which casting procedure is utilized, the steel composition may be essentially the same, within the broad limits set forth below, in weight percent:

| | |
|---|---|
| Carbon | Up to 1.0 |
| Manganese | 0.30–1.6 |
| Sulfur | Up to 0.35 |
| Bismuth | 0.10–0.40 |
| Tellurium | Machinability increasing amounts up to 0.06 |
| Silicon | Up to 0.30 |
| Phosphorous | Up to 0.12 |
| Iron | Essentially the balance |

A machinability increasing amount of tellurium is generally about 0.02 wt.%, minimum. Up to 0.15 wt.% lead is optional.

A bath of molten steel having a composition within the range set forth above is then cast into an elongated, solid shape such as an ingot. The amounts of manganese and bismuth, within the ranges set forth above, are sufficient so that, when the steel is in solid form and no lead is present, all of the tellurium is combined with the manganese and/or the bismuth as microinclusions of manganese telluride and/or bismuth telluride and the bismuth is also present as microinclusions of elemental bismuth, there being substantially no iron telluride (FeTe) present in the solid steel. Iron telluride has a detrimental effect from the standpoint of causing surface cracking during hot deforming.

After the steel has been cast into an ingot, and the ingot has cooled, the ingot is removed from the ingot mold, reheated (an operation known as soaking), and then subjected to a hot rolling operation at a hot rolling temperature in the range 920°–1150° C. (1700°–2100° F.) wherein the ingot is rolled into a bloom. The resulting intermediate, hot deformed steel shape, i.e. the bloom, has a surface substantially devoid of surface cracking, prior to any surface conditioning of the bloom. The bloom is then reheated and hot rolled at a temperature in the range 920°–1150° C. (1700°–2100° F.) to produce a billet having a surface substantially free of surface cracking prior to any surface conditioning thereof, and there is no need to conduct a surface removal step between the bloom reheating step and the step of hot rolling the bloom into a billet.

Not only is the surface of the bloom or billet devoid of substantial surface cracking, but, also, the surface is devoid of burning in the as-deformed condition, due to the fact that the steel shape is rolled at a temperature (1150° C. max.) (2100° F. max.), below that at which burning of the steel occurs.

In a manufacturing procedure wherein the billet is formed by a continuous casting operation, the steps comprise continuously casting molten steel (having a composition within the ranges set forth above) into a strand and then roll straightening the strand while the latter is at a temperature in the range 920°–1100° C. (1700°–2000° F.). The strand, which already has the cross section of a billet, is then cut into the usual billet lengths.

The roll straightening step which the strand undergoes at the temperature range described above is tantamount to a hot deforming step, but the surface of the strand, and of the billets which are cut from the strand, are devoid of surface cracking and burning in the as-deformed condition.

A billet formed from either of the above-described manufacturing procedures has an oxide on its surface in the billet's as-deformed condition. This is reflective of the fact that the billet has not undergone any surface conditioning. As used herein the term "as-deformed condition" refers to the condition of the billet immediately after being hot rolled (or otherwise hot deformed) and before it undergoes any surface conditioning following the hot deforming step.

Surface conditioning is a procedure conventionally utilized to remove surface imperfections or portions from semi-finished steel articles after a hot deforming step and includes grinding, chipping, scarfing, planing and the like.

The combined lead plus bismuth content of the steel shape should be at least 0.25 wt.% to supply the desired machinability. Therefore, in that embodiment of the invention wherein lead is completely absent, the bismuth content should be at least 0.25 wt.%. In that embodiment of the invention wherein lead is present up to 0.15 wt.%, the bismuth may be less than 0.25 wt.% so long as the combined lead and bismuth content is 0.25 wt.% minimum.

In that embodiment of the invention in which some lead is added to the steel (up to 0.15 wt.% max.), although there may be small amounts of lead tellurium microinclusions in the steel, these amounts are insufficient to produce substantial surface cracking during the hot deforming step. This is because not only is the lead content limited to 0.15 wt.% max., in this embodiment, but, also, the tellurium content is limited to 0.02 wt.% max.

The present invention may be applied to virtually all steel base compositions to which lead and tellurium have previously been added. Examples thereof are set forth in Holowaty U.S. Pat. No. 3,152,889, and the disclosure therein is incorporated herein by reference. Examples of steel compositions in accordance with the present invention are contained in the table set forth below.

| | Weight % | | | |
|---|---|---|---|---|
| Ingredients | A | B | C | D |
| Carbon | 0.06–0.08 | 0.45–0.47 | 0.41–0.43 | 0.06–0.09 |
| Manganese | 0.9–0.10 | 1.52–1.60 | 1.45–1.55 | 0.75–1.05 |
| Sulfur | 0.3–0.33 | 0.29–0.33 | 0.35 max. | 0.26–0.33 |
| Bismuth | 0.3–0.4 | 0.27–0,33 | 0.2–0.3 | 0.1–0.2 |
| Tellurium | 0.04–0.06 | 0.05 | 0.05 | 0.02 |
| Lead | — | — | — | 0.15 |
| Silicon | 0.01–0.02 | 0.20–0.25 | 0.15–0.30 | 0.02 max. |
| Phosphorous | 0.06–0.07 | 0.03 max. | 0.03 max. | 0.06–0.09 |

In all of the above steels A-D, the balance of the composition consists essentially of iron (plus the usual impurities).

Generally speaking, the present invention may be applied to plain carbon steels having a base composition (i.e. a composition without lead, tellurium or bismuth) in the 1000 series, 1100 series or 1200 series of steels (AISI Numbers) in which the lead, tellurium and bismuth contents are controlled as described above and which, in their solidified form, are subjected to hot deforming procedures (including hot deforming temperatures) as described above. The present invention may also be applied to certain alloy steels to which lead and tellurium have heretofore been added, such as steels having compositions corresponding to AISI steels 4140, 4142 and 8620.

The foregoing detailed description has been given for clearness of understanding only, and no unnecessary limitations should be understood therefrom, as modifications will be obvious to those skilled in the art.

What is claimed is:

1. A method for producing a free-machining, elongated, semi-finished, tellurium-containing steel shape with substantially reduced surface cracking due to lead telluride, said method comprising the steps of:

providing a bath of molten steel having a composition consisting essentially of, in wt.%:

| | |
|---|---|
| carbon | 0.06–1. |
| manganese | 0.30–1.6 |
| sulfur | up to 0.35 |
| bismuth | 0.10–0.40 |
| tellurium | machinability increasing amounts up to 0.06 |
| lead | up to 0.15 |
| silicon | up to 0.30 |
| phosphorous | up to 0.12 |
| iron | essentially the balance; |

casting said molten steel into an elongated solid shape;

the combined lead plus bismuth content being at least 0.25 wt.%, said steel being provided with sufficient manganese and bismuth so that, in said solid shape, said tellurium is combined substantially with said manganese and/or said bismuth as micro-inclusions of MnTe and/or $Bi_2Te_3$ and said bismuth is also present as microinclusions of elemental bismuth, there being substantially no FeTe present in said solid shape;

heating said elongated steel shape to a hot deforming temperature, without burning the steel shape;

and hot deforming said elongated shape while the latter is at a temperature above about 920° C. (1700° F.) and below 1150° C. (2100° F.), without surface removal between said heating step and said hot deforming step, to produce an elongated, deformed, semi-finished steel shape having a surface substantially free of surface cracking prior to any surface conditioning thereof;

said steel, in said solid shape, being devoid of microinclusions of lead telluride in amounts sufficient to produce substantial surface cracking during said hot deforming step at a temperature below 1150° C. (2100° F.).

2. A method as recited in claim 1 wherein:

said casting step comprises casting said molten steel into an ingot;

and said hot deforming step comprises reheating said ingot and then hot rolling said reheated ingot into a bloom with said ingot at a hot rolling temperature above about 920° C. (1700° F.) and below 1150° C. (2100° F.);

there being no surface removal step between said reheating step and said hot rolling step.

3. A method as recited in claim 2 and further comprising:

reheating said bloom and then hot rolling said bloom at a temperature above about 920° C. (1700° F.) and below 1150° C. (2100° F.) to produce a billet having a surface substantially free of surface cracking prior to any surface conditioning thereof;

there being no surface removal step between said bloom reheating step and said last-recited hot rolling step.

4. A method as recited in claim 1 wherein:

said casting step comprises continuously casting said molten steel into a strand;

and said hot deforming step comprises roll straightening said strand while the latter is at a temperature above about 920° C. (1700° F.). and below 1100° C. (2000° F.)

5. A method as recited in claim 1 wherein:

said hot deforming step is performed at a temperature below 1035° C. (1900° F.).

6. A method as recited in claim 1 wherein:

said steel contains lead;

and said tellurium content is 0.02 wt.% max;

said steel, in said solid shape, having micro-inclusions of PbTe in amounts insufficient to produce substantial surface cracking during said hot deforming step at a temperature below 1150° C. (2100° F.).

* * * * *